United States Patent [19]

Ziels

[11] Patent Number: 4,567,622

[45] Date of Patent: Feb. 4, 1986

[54] SOOTBLOWER NOZZLE APPARATUS

[75] Inventor: Burton D. Ziels, Lancaster, Ohio

[73] Assignee: The Babcock & Wilcox Company, New Orleans, La.

[21] Appl. No.: 590,264

[22] Filed: Mar. 16, 1984

[51] Int. Cl.[4] ..... F23J 3/02

[52] U.S. Cl. ..... 15/316 R

[58] Field of Search ..... 15/316 R, 316 A, 317, 15/318

[56] References Cited

U.S. PATENT DOCUMENTS

| | | | |
|---|---|---|---|
| 1,785,821 | 12/1930 | Snow . | |
| 1,902,736 | 3/1933 | Thomas . | |
| 1,944,325 | 1/1934 | Thomas | 122/392 |
| 1,966,912 | 7/1934 | Turner | 122/392 |
| 2,023,108 | 12/1935 | Thomas et al. | 122/392 |
| 2,441,112 | 5/1948 | Hibner et al. . | |
| 2,897,532 | 8/1959 | Cantieri | 15/317 |
| 3,138,819 | 6/1964 | McColl | 15/317 |
| 3,216,044 | 11/1965 | Chappell | 15/317 |
| 3,216,045 | 11/1965 | McColl | 15/317 |
| 3,436,786 | 4/1969 | Rickard et al. | 15/317 |
| 3,439,376 | 4/1969 | Nelson et al. | 15/317 |
| 4,173,808 | 11/1979 | Blaskowski | 15/316 R |
| 4,209,028 | 6/1980 | Shenker | 15/316 A X |
| 4,346,674 | 8/1982 | Merritt | 15/316 R X |

FOREIGN PATENT DOCUMENTS

| | | | |
|---|---|---|---|
| 39113 | 6/1931 | France | 15/317 |
| 137814 | 9/1979 | German Democratic Rep. . | |

*Primary Examiner*—Chris K. Moore

*Attorney, Agent, or Firm*—Harness, Dickey & Pierce

[57] ABSTRACT

A retracting lance tube for a sootblower used to clean the interior of large scale boilers featuring nozzle improvements which produce a more concentrated spray of blowing agent discharge thereby enhancing cleaning performance. According to a first embodiment of this invention, nozzles are employed at various longitudinal positions along the lance tube. According to a second embodiment, nozzles located at a particular longitudinal position are offset such that their centerlines do not intersect the lance tube centerline. Each embodiment enables the use of longer more efficient nozzles than is possible according to the prior art.

7 Claims, 7 Drawing Figures

Fig-1
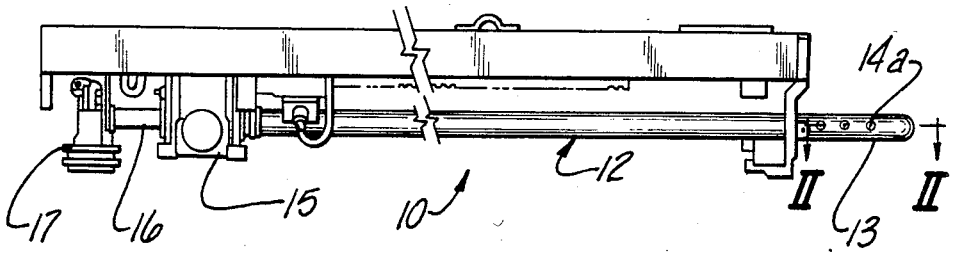
Fig-2
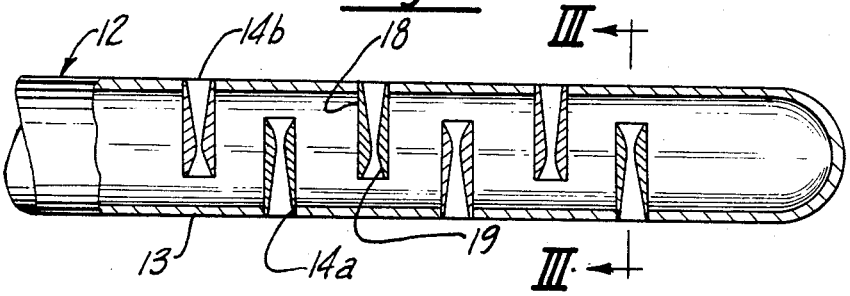
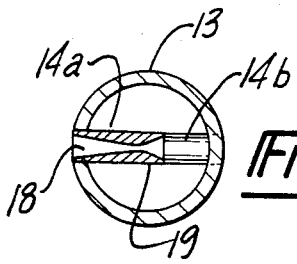
Fig-3
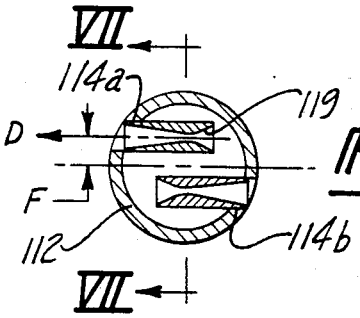
Fig-6
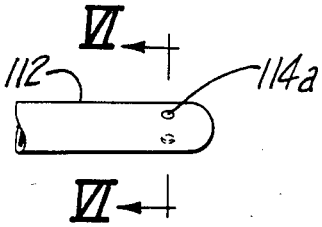
Fig-5
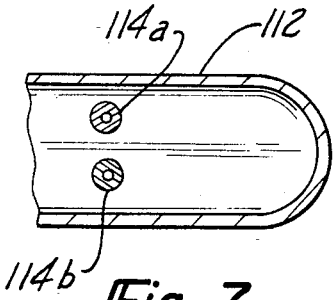
Fig-7

SOOTBLOWER NOZZLE APPARATUS

BACKGROUND OF THE INVENTION

This invention relates to cleaning apparatus of the sootblower type employed to direct jets of air, steam, water, or a mixture of such agents against fouled or slag-encrusted components of large scale boilers and other heat-exchangers typically used by public utilities and in industry for the production of steam for power generation and other purposes. (The term "boiler" is intended to encompass other heat-exchangers to which this invention is applicable.) The invention relates particularly to sootblowers of the retracting type, wherein the cleaning jets are moved into the boiler to clean and upon completion of their cleaning cycle, are then withdrawn from the severe environment therein. Sootblowers of this type employ a retracting lance tube typically having two or more radially directed nozzles near the outer end.

In order to equalize the jet reaction forces on the cantilevered lance tube when it is in operation in the boiler, the nozzles are oppositely or equally spaced peripherally and their axis intersects the longitudinal axis of the lance tube. In order to permit the lance tube to move into and out of the boiler through the substantially sealed and/or air-shielded opening in the wall box, the nozzles must, as a practical matter, be located entirely within the lance tube. Due to the restricted diameter of the lance tube and the volume of blowing medium normally required for effective cleaning and/or to adequately cool the lance while it is in the boiler, it has in many instances been impossible to provide opposing nozzles having optimal dimensions for the production of a concentrated high velocity jet that is desired for efficient cleaning.

As a sootblower lance is inserted into and retracted from the boiler, it is simultaneously rotated and/or oscillated about its longitudinal axis so that the blowing medium jet sweeps a helical or partially helical path. The lance typically rotates a number of times during its projection and retraction movement. Since the speed at which the lance may safely be rotated is limited by the critical speed above which the lance becomes dynamically unstable, the total cycle time required to insert and retract the lance becomes restricted by this consideration. Therefore, for some applications, the cycle time of a sootblower must be made greater in duration than dictated by cleaning requirements. In many instances, particularly where high combustion gas temperatures or wide boilers are involved, a certain minimum flow of blowing medium must be maintained in order to provide sufficient cooling to protect the lance tube in this severe environment, resulting in a considerable waste of blowing medium. Moreover, longer sootblower cycle times lead to additional power consumption and component wear.

Fluidic pressure of blowing medium acting on the lance tube exerts a projecting force on the lance which resists lance retraction, thereby requiring considerably more energy to retract the lance than to insert it. Reduction in retraction load would result in reducing power consumption and would decrease component mechanical loading.

This invention is directed to addressing the above-mentioned shortcomings and design concerns of prior art sootblowers of the retracting type.

One of the objects of this invention is the provision of improved lance tube designs which permit the use of more efficient nozzle configurations thereby enhancing the sootblower cleaning performance. A further object is to reduce the number of lance rotations necessary to achieve a desired jet path spacing. A still further object of the invention is to provide means for partially counteracting the rotational component of the lance pressure force acting to cause lance insertion and acting against lance retraction. Another object of this invention is to provide a long retracting sootblower design which features improved efficiency in terms of blowing medium consumption during cleaning.

It has been common practice in the prior art to employ two or more nozzles at one longitudinal position of the lance of a long retracting blower. With the large volume of blowing medium required for lance cooling and adequate cleaning, these configurations lead to short relative nozzle lengths which results in high turbulence and rapid dispersion of the discharged blowing medium. Additionally, the close proximity of the inlets of nozzles to one another further introduces turbulence and restriction to flow.

The ratio of the nozzle length to its throat diameter is an important parameter in establishing the nozzle flow condition, generally the larger the ratio the less turbulent the jet from the nozzle, which produces a more concentrated jet stream thus achieving greater impact pressures at a given distance for a given flow rate. By placing nozzles at different longitudinal positions so they are not directly opposite each other, greater nozzle lengths and a greater number of nozzles may be employed, improving the ratio of the length of the nozzle to the throat diameter. Further, by spacing the nozzles such that their centerlines are not colinear, each may project further into the lance tube such that the fluid flow into each is minimally obstructed by other nozzles, thereby reducing restriction and turbulence. By placing a plurality of nozzles in the lance tube at different longitudinal positions along the lance, an important additional benefit is realized. Such a configuration enables the ratio of rotational travel to longitudinal travel of the lance to be reduced while maintaining a desired cleaning effect. As will be shown, the number of lance rotations necessary to produce a desired pitch spacing between spray paths is inversely related to the number of different lance longitudinal positions where nozzles are placed and the number of nozzles at those locations. A reduction in rotational velocity to longitudinal velocity correspondingly enables shorter cycle times before lance dynamic instability becomes a problem.

A further object of this invention is to provide an improved lance having opposing nozzles which are offset such that their longitudinal axes do not intersect the lance tube centerline. The offset mounting is such that longer, more efficient nozzles may be used to produce higher jet impact pressures than otherwise would be obtainable, and, further, a thrust reaction couple is generated which acts upon the lance in a retracting direction. Since the lance rotation and longitudinal movement are related by a gear drive within the blower carriage mechanism, the applied torque causes a longitudinal force on the lance. By causing nozzle thrust to oppose the direction of rotation of the lance on insertion, the tendency for the lance to be projected into the boiler on carriage "runaway" is at least partially offset. Conversely, the nozzle thrust aids in retraction since the direction of rotation is reversed. Since the peak lance drive loads occur upon retraction, this improvement permits the use of more efficient drive systems.

BRIEF DESCRIPTION OF THE DRAWINGS

FIG. 1 is a side elevational view, centrally broken away, of a long travel sootblower of the well-known IK type, having a lance including the features of the first embodiment of the present invention.

FIG. 2 is a cross-sectional view taken along line 2—2 of FIG. 1 showing the nozzles in section and further showing a plurality of nozzles at various longitudinal positions along the lance according to the first embodiment of this invention.

FIG. 3 is a cross-sectional view taken along line 3—3 of FIG. 2.

FIG. 5 is a side-elevational view of the nozzle block of a lance broken away from the remainder of the lance, according to the second embodiment of this invention, illustrating the positions of the offset nozzles.

FIG. 6 is a sectional view of the nozzle block taken along line 6—6 of FIG. 5 showing the alignment of the nozzles such that the longitudinal axis of each nozzle does not intersect the lance longitudinal axis according to the teachings of the second embodiment of this invention.

FIG. 7 is a sectional view taken along line 7—7 of FIG. 6 further showing the offset nozzle mounting according to the second embodiment of this invention.

DETAILED DESCRIPTION OF THE INVENTION

Figure 4:
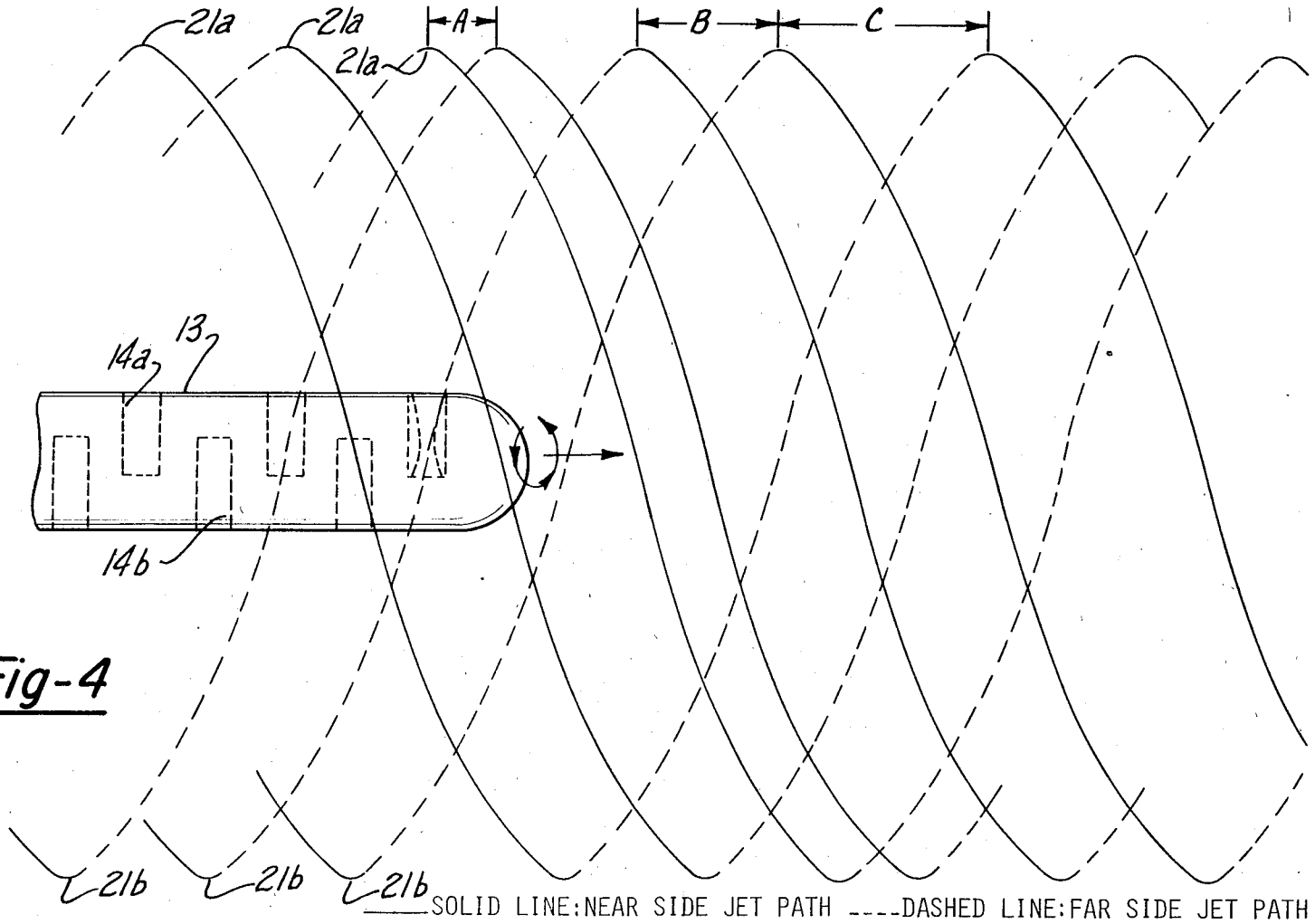
FIG. 4 is a diagrammatical representation of the helical paths traced by the jets from the nozzles of the lance according to the first embodiment of this invention as the lance is simultaneously advanced and rotated in the direction shown.

With reference to FIG. 1, a sootblower of the long retracting variety is shown and is designated generally by reference character 10, the general construction of which is disclosed by U.S. Pat. No. 3,439,376 granted to J. W. Nelson et al on Apr. 22, 1969. Numerous additional features have been incorporated into sootblowers of the type shown subsequent to the above-mentioned disclosure; however, such details are not involved in the present invention. The sootblower depicted by FIG. 1 will be recognized as typical of the structural environment wherein the present invention can be advantageously employed. In addition to structure taught by the prior art, FIG. 1 illustrates the novel means of employing a plurality of nozzles at various positions according to the first embodiment of this invention, which is further shown by FIGS. 2, 3 and 4.

Lance tube 12, shown in FIG. 1, is inserted reciprocally into a boiler or furnace presumed to be located to the right in the illustration to clean the heat exchanging and other interior surfaces by the discharge of blowing agents such as air, water and/or steam from nozzles 14*a* and 14*b*. Lance tube 12 is affixed to motor driven carriage 15 which controls the movement of the lance tube. Carriage 15 imparts a simultaneous rotational and longitudinal motion to lance tube 12 as it is cycled into and withdrawn from the boiler to perform its cleaning function. The longitudinal distance over which the lance 12 must move while a complete revolution is achieved is referred to as the helix distance or pitch. Lance tube 12 is slidably overfitted upon stationary feed tube 16. Blowing medium supplied to feed tube 16 is controlled by blow valve 17 and is conducted into lance tube 12 and thereafter exists through nozzles 14*a* and 14*b*.

The improved nozzle block indicated by reference character 13 is shown particularly with reference to FIG. 2. A plurality of nozzles 14*a* and 14*b* are shown each having a discharge end 18 fixedly mounted in and discharging through the wall portion of lance tube 12. In accordance with the first embodiment of this invention, a plurality of nozzles 14*a* and 14*b* are located at longitudinally spaced positions along the lance. By placing the nozzles longitudinally apart, a less restricted fluid flow path into each is provided. The greater number of nozzles provides adequate lance cooling flow with nozzles of lesser diameter. Longer nozzle lengths coupled with a smaller throat dimension possible through increasing the total number of nozzles results in production of a more penetrating jet stream discharge for more efficient cleaning performance.

An important additional benefit is realized through the nozzle mounting according to the first embodiment of this invention and is best explained with reference to FIG. 4. The helical paths of the jets discharged from nozzles 14*a* and 14*b* are diagrammatically illustrated as lance 12 is simultaneously rotated and advanced by motor driven carriage 15 in the directions indicated by FIG. 4. The helical paths outlined by nozzles 14*a* which are shown initially directed upwardly are designated by reference character 21*a*, whereas those paths outlined by nozzles 14*b*, which are initially downwardly directed, are designated by reference character 21*b*. As is evident from FIG. 4, paths 21*a* and 21*b* form intertwined advancing helical bands. Path spacing is chosen such that the jets impact close enough to effectively perform the boiler cleaning functions. Nozzle placement, as described, results in a reduction in lance revolutions necessary to achieve a desired path spacing. It is necessary, however, to choose nozzle longitudinal spacing consistent with the helix distance. In the embodiment illustrated by FIG. 4, the distance between the furthest separated nozzles is approximately one-half the helix distance. A lance tube having nozzles mounted as shown by FIG. 2 does, however, result in some non-uniformity in jet path spacing. From FIG. 2 it is shown that dimensions A, B, and C, which indicate the distance between adjacent jet paths, are non-uniform since pairs of nozzles are not mounted opposite one another, in which case spacing could be made uniform. Depending upon the application, the advantages of staggered or opposing nozzles are weighed and the appropriate configuration utilized. It is also possible to combine staggered radial and longitudinal nozzle spacing to minimize path irregularities.

The sootblower lance according to the first embodiment of this invention therefore, produces significant benefits in two areas. First, more efficient nozzles may be employed resulting in a more concentrated, higher impact jet from each nozzle. Second, the number of lance rotations is reduced which permits shorter cycle times in cases where the cycle time is dictated by the concerns for lance tube resonance. Reducing cycle time translates into major savings in terms of blowing medium usage, energy and component wear.

The second embodiment of the present invention is depicted by FIGS. 5, 6, and 7 wherein nozzles 114*a* and 114*b* are offset from each other in such a manner that their longitudinal axes do not intersect the lance centerline axis. As shown, the nozzles are equidistant from and parallel to a longitudinal diametric center plane of the lance. This offset nozzle configuration also permits the installation of longer nozzles than is possible using conventionally directed colinear opposing nozzles. In addition to allowing relatively longer nozzles, this configuration provides a relatively unobstructed nozzle inlet 119 thereby further enhancing compactness of the jet pattern and to increase impact pressure.

It will be noted that in both embodiments of the invention the nozzles are completely offset from each other, and that this permits each nozzle to extend more than halfway across the interior of the lance, as distinguished from prior art arrangements wherein the length of the nozzles must be less than half the internal diameter of the lance tube.

By mounting the nozzles in the offset manner according to the second embodiment, flow through the nozzles produces a reaction thrust couple which causes a torque to be applied to the lance. The magnitude of the reaction thrust is the mass flow rate through the nozzle times the fluid velocity passing therethrough, or expressed in another way, the reaction thrust is equal to the fluid pressure in the nozzle times a cross-sectional area of the nozzle. The reaction force times the length of a line perpendicular to the line of action of a nozzle reaction thrust, measured from the line of action to the center of rotation of lance 112, equals the torque applied to the lance from each nozzle. These forces and distances are shown in FIG. 6 as reaction force D and radial distance F. During operation, this torque on lance 112 partially offsets the carriage gear force tending to cause lance extension caused by the pressure of blowing medium within the lance. The nozzles are offset in a direction such that the jet reaction on the lance opposes its rotation in the direction corresponding to projecting movement. This offsetting is achieved, with reference to the example presented by the drawings, to cause a lance torque to be exerted in a clockwise direction as viewed from the nozzle end of lance 112 as shown by FIG. 6. Conversely, the reactive torque acts to aid in the retraction of lance 112 as it is withdrawn, since the lance rotation is reversed upon retraction, thereby reducing carriage drive system loading.

It should be noted that the separate embodiments described herein relating to this invention can be combined so that the advantages of both are realized in one structure. For example, the nozzles of the lance tube illustrated in FIGS. 2 and 3 can be offset similarly to the nozzles in FIG. 5. The nozzles are mounted so that the reaction thrust produced by each acts in the same (retracting) rotational direction so that the force offsetting and retracting assisting features of the second embodiment result.

While preferred embodiments of the invention have been described herein, it will be appreciated that various modifications and changes may be made without departing from the spirit and scope of the appended claims.

What is claimed is:

1. In a sootblower of the type having; a lance tube, means for moving the lance tube to project it into and retract it from the interior of a boiler or the like, means for imparting rotation to the lance tube, means for supplying a blowing agent to the lance tube for discharge from an outer end portion of the lance tube during its movement, and a plurality of similar nozzles mounted in such outer end portion thereof and through which the blowing agent is discharged; the improvement comprising the axes of the nozzles being longitudinally displaced from each other a distance so related to the movement of the lance tube that jets from the nozzles trace different helical paths.

2. A sootblower as defined in claim 1 wherein the nozzles are disaligned by displaced positioning thereof on opposite sides of a longitudinal diametric center plane of the lance tube.

3. A sootblower as defined in claim 2 wherein the nozzles have discharge portions directed in opposite direction whereby discharge from the nozzles imparts torque to the lance tube.

4. A sootblower as defined in claim 3 wherein the means for moving the lance tube comprises a single motor which drives the lance tube simultaneously both axially and rotatably and imparts rotation thereto in one angular direction during projection of the lance tube and in the opposite angular direction during retraction of the lance tube, the discharge portions of the nozzles being positioned to impart torque to the lance tube in the direction corresponding to retraction thereof.

5. In a sootblower of the type having; a lance tube, means for driving the lance tube simultaneously both axially and imparting rotation thereto in one angular direction during projection of the lance tube and in the opposite angular direction during retraction of the lance tube, means for supplying a blowing agent to the lance tube for discharge from an outer end portion of the lance tube during its movement, and a plurality of similar nozzles mounted in such outer end portion thereof and through which the blowing agent is discharged, the improvement comprising the axes of the nozzles being disaligned by displaced positioning thereof on opposite sides of a longitudinal diametric center plane of the lance tube whereby discharge from the nozzles imparts torque to the lance tube in the direction corresponding to the direction of rotation of the lance tube during retraction thereof.

6. A sootblower as defined in claim 1 wherein said nozzles are further displaced relative to each other longitudinally with respect to the lance tube.

7. A sootblower as defined in claim 5 wherein the means for moving the lance tube imparts rotating and axial movement thereto, the nozzles being displaced from each other a distance so related to the movement of the lance tube that jets from the nozzles trace different helical paths.

* * * * *

UNITED STATES PATENT AND TRADEMARK OFFICE

CERTIFICATE OF CORRECTION

PATENT NO. : 4,567,622

DATED : February 4, 1986

INVENTOR(S) : Burton D. Ziels

It is certified that error appears in the above-identified patent and that said Letters Patent is hereby corrected as shown below:

At Column 6, Claim 6, line 49, delete "1" and insert therefor --5--.

Signed and Sealed this

Tenth Day of March, 1987

*Attest:*

DONALD J. QUIGG

*Attesting Officer*

*Commissioner of Patents and Trademarks*